US006375766B1

(12) United States Patent
Czech

(10) Patent No.: US 6,375,766 B1
(45) Date of Patent: Apr. 23, 2002

(54) NICKEL-BASE ALLOY AND ARTICLE MANUFACTURED THEREOF

(75) Inventor: Norbert Czech, Dorsten (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/283,593

(22) Filed: Apr. 1, 1999

Related U.S. Application Data

(63) Continuation of application No. PCT/EP97/05343, filed on Sep. 29, 1997.

(30) Foreign Application Priority Data

Oct. 1, 1996 (EP) ..... 96115738

(51) Int. Cl.[7] ..... C22C 19/05

(52) U.S. Cl. ..... 148/427; 148/428; 148/410; 420/442; 420/445

(58) Field of Search ..... 420/441, 442, 420/445; 148/426, 427, 428, 410

(56) References Cited

U.S. PATENT DOCUMENTS

RE29,920 E * 2/1979 Baldwin

OTHER PUBLICATIONS

Ochiai, S., Oya, Y. and Suzuki, T., "Alloying Behavior of Ni3Al, Ni3Ga, Ni3Si, and Ni3Ge", 1984, Acta Metallurica, vol. 32, No. 2, pp. 289–298.*

* cited by examiner

*Primary Examiner*—Roy King
*Assistant Examiner*—Harry D. Wilkins, III

(57) ABSTRACT

A nickel-base alloy containing a continuous matrix composed of a solid solution of chromium in nickel and a precipitate granularly dispersed in and coherent with the matrix and composed of an intermetallic nickel compound. The intermetallic nickel compound contains gallium that replaces aluminum and/or titanium partly or completely. The invention also relates to an article of manufacture containing a substrate formed of such a nickel-base alloy.

25 Claims, No Drawings

NICKEL-BASE ALLOY AND ARTICLE MANUFACTURED THEREOF

CROSS REFERENCE TO RELATED APPLICATION

This application is a continuation of International Application PCT/EP97/05343, filed Sep. 29, 1997, which designated the United States.

BACKGROUND OF THE INVENTION

Field of the Invention

The invention relates to a nickel-base alloy including a continuous matrix composed of a solid solution of chromium in nickel and a precipitate granularly dispersed in and coherent with the matrix and composed of an intermetallic nickel compound. The invention also relates to an article of manufacture including a substrate formed of such a nickel base alloy.

Nickel-base alloys without a precipitate granularly dispersed in a nickel and chromium matrix and without having an inter-metallic nickel compound are widely used in different technical fields. U.S. Pat. No. 3,898,081 for example relates to nickel-base alloys, and, more particularly, to alloys especially useful as high precision resistor materials used in manufacturing resistors for various measurements circuits to control instrumentation. These nickel-base alloys include a combination of such additives as chromium, vanadium and gallium and have a resistivity of from 1.7 to 2.2 $\mu\Omega\times m$. The content of gallium lies in the range of between 6 to 12%.

U.S. Pat. No. 3,907,555 relates to corrosion resistant precision casting alloys particularly suitable for use as dental alloy. The alloy is hot workable and hardenable and consists essentially, by weight of at least 60% nickel, 10 to 25% chromium, 1 to 7.5% gallium, 0.5 to 1.5% manganese and optionally tin, copper, silicon, aluminum, cobalt, and carbon to some percent.

The total amount of tin and gallium does not exceed 7.5%. In the alloy the same characteristics of gallium and tin are used to obtain good casting properties.

International Patent Application WO 82/03007 A1, corresponding to U.S. Pat. No. 4,459,262, relates to a cobalt and nickel alloy, in particular for the preparation of dental protheses. The alloy has sufficient qualities of corrosion and wear resistance, is cold-deformable and retains its color, is easily workable in a molten state and shows hardness values equivalent to those of noble metal alloys. Beside the base metals cobalt and nickel, the alloy contains as main components by weight 10 to 15% chromium and 0.2 to 4.5% gallium. The alloy can be used especially for preparing base plates, anchoring hooks and fastening hooks for mobile protheses.

A nickel-base alloy and an article of manufacture containing a substrate formed of such a nickel-base alloy is apparent from the book "Superalloys II", edited by C. T. Sims, N. S. Stoloff and W. C. Hagel (editors), John Wiley & Sons, New York 1987. Of particular relevance in this context are chapter 4 "Nickel-base alloys", pages 97–134, chapter 7 "Directionally Solidified Superalloys", pages 189–214, and chapter 20 "Future of Superalloys", pages 549–562. The book discloses particular embodiments of such nickel-base alloys, termed as "superalloys". These superalloys are characterized by superior mechanical properties under heavy mechanical and thermal loads at temperatures amounting up to 90% of the respective melting temperatures.

A nickel-base superalloy can be characterized in general terms as set out above. In general, a nickel-base superalloy contains a continuous matrix composed of a solid solution of chromium in nickel and a precipitate granularly dispersed in and coherent with the matrix and composed of an intermetallic nickel compound. To specify the precipitate as coherent with the matrix means that crystalline structures of the matrix are continued into the grains of the precipitate. Thus, there are in general no physical boundaries between the matrix and the grains of the precipitate. Instead, an interface between the matrix and a grain of the precipitate will be characterized by a local change in chemical composition through a continuous, however strained, crystal lattice.

In a superalloy, both the matrix and the precipitate have a face-centered cubic crystal structure. The material of the matrix is usually specified as a "gamma-phase", the material of the precipitate is specified as a "gamma-prime-phase". The gamma-prime-phase has a composition that is generally specified as $A_3B$, where A is generally nickel and B is generally aluminum or titanium. Generally, both the matrix and the precipitate are more or less highly alloyed; not all chromium is concentrated in the matrix, and not all aluminum and/or titanium is concentrated in the precipitate. Also, further elements are generally present in the alloy, and these elements are likewise distributed in the matrix as well as in the precipitate. Eventually, such elements may form other precipitates, particularly carbides or borides. Such compounds are formed with carbon or boron on one hand and elements like tungsten, molybdenum, hafnium, zirconium and others, as apparent from the book, on the other side. Carbides in particular play a more or less important role in commercially used superalloys. Boron is also frequently found in commercially used superalloys.

To manufacture a superalloy article with specified properties, not only control of its chemical composition is necessary, but also control of the manufacturing process which necessarily includes a heat treatment for the article after it has been brought to shape by casting or working. Normally, the heat treatment starts with a step called solutioning, where the superalloy is heated to a temperature near the incipient melting point to homogenize and dissolve precipitates which may have formed during casting or working. The solutioning will be finished by rapid cooling to retain the homogenous structure. Subsequently, at least one aging step will be performed by heating the article to a prescribed and carefully controlled temperature, in order to initiate the forming of the desired precipitate or the desired precipitates. Relevant particulars of such heat treatment processes may be found in the relevant chapters of the book.

Nickel-base superalloys to be used for the manufacture of gas turbine components like blades, vanes and heat shield elements are apparent from U.S. Pat. No. 5,401,307. The patent contains a survey of superalloys which are of concurrent practical importance, and the patent also elaborates on protective coatings which may be used to protect a superalloy article against corrosion and oxidation at high temperatures, as occurring during service in gas turbines.

Frequently a thermal barrier coating is used to extend the thermal loadability of a thus coated superalloy article to a higher temperature than without the thermal barrier layer. In general, a thermal barrier layer for a superalloy article is applied on a bond coating, which may be formed of an alloy or an intermetallic compound which itself has protective properties with respect to corrosion and erosion and is applied between the superalloy substrate and the ceramic thermal barrier coating. Examples of such protective coatings can be seen from U.S. Pat. No. 5,401,307 already mentioned.

U.S. Pat. No. 5,262,245 describes an effort to modify a superalloy in order to make it suitable to develop a thin film of aluminum on its surface, which film can be used to anchor a ceramic thermal barrier coating directly on the superalloy.

Recent efforts to improve creep rupture properties of nickel-base superalloys have resulted in alloys wherein the proportion of the intermetallic precipitate amounts up to 50% in parts by volume and even more. Therefore, these alloys have superior creep properties at temperatures above 750° C. However, it has been observed that a steady increase of the proportion of the intermetallic precipitate in a superalloy leads to a remarkable embrittlement, since the pronounced brittleness of the intermetallic compounds that usually form the precipitate tends to dominate the mechanical properties of the superalloy. Finally, this results in an intolerable decrease in toughness. Furthermore, the solvability of chromium in the superalloy is remarkably reduced, since most of the chromium must be stored in the matrix, whose proportion must be reduced as the proportion of the precipitate is increased. This leads to a decrease in corrosion resistance, which as a rule is promoted by chromium. Corrosion resistance may not be a highly important property of a superalloy, since a protective coating is generally used in a high temperature application. However, a certain corrosion resistance must be retained even for the superalloy forming a substrate for a high temperature application, in order to avoid immediate failure of the substrate if the protective coating is lost by some kind of damage.

Additionally, long-time stability of the gamma-prime-phase of the precipitate at high temperatures may result in problems. By thermally activated diffusion processes, the precipitate may change its relevant properties. In particular, fine grains of the precipitate begin to grow within a process known as "Ostwald ripening". Ostwald ripening also changes the shape of the grains of the precipitate from a basically cubic structure to a globular structure. Thereby, the grains lose their toughening properties at least partly, which can be verified by creep rupture tests at high temperatures.

SUMMARY OF THE INVENTION

It is accordingly an object of the invention to provide a nickel-base alloy and an article manufactured thereof that overcomes the above-mentioned disadvantages of the prior art devices of this general type, which retains its potential for improvement of its creep rupture properties by increasing the proportion of precipitate and yet avoids the disadvantages of embrittling, Ostwald ripening and loss of solvability for chromium as explained.

With the foregoing and other objects in view there is provided, in accordance with the invention, a nickel-base alloy for high temperature application, including: a continuous matrix composed of a solid solution of chromium in nickel and a precipitate composed of an intermetallic nickel compound and granularly dispersed in and coherent with the continuous matrix, the intermetallic nickel compound containing gallium, the continuous matrix containing gallium oxide ($Ga_2O_3$) for providing a high corrosion resistance and having a balance of nickel, chromium and unavoidable impurities.

Other features which are considered as characteristic for the invention are set forth in the appended claims.

Although the invention is described herein as embodied in a nickel-base alloy and an article manufactured thereof, it is nevertheless not intended to be limited to the details recited, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments.

DESCRIPTION OF THE PREFERRED EMBODIMENTS

In accordance with the invention, gallium is introduced into the gamma-prime-phase of the invention to replace the commonly used elements aluminum and titanium partly or completely. Gallium is homologous to aluminum in the periodic system of elements and has chemical properties that are fairly similar to the respective properties of aluminum. In particular, gallium can form intermetallic compounds with nickel which closely resemble the homologous intermetallic compounds of aluminum and nickel. A phase having the composition $Ni_3Ga$ has the same crystal structure as $Ni_3Al$ that is the prototype compound to form the precipitate in a nickel-base superalloy. Like aluminum, gallium forms a very stable oxide $Ga_2O_3$, which can provide the alloy with an oxidation resistance property like alumina. Thus, the beneficial effects of aluminum are retained for the alloy wherein gallium has replaced aluminum.

An important advantage of the use of gallium instead of aluminum and/or titanium is seen in that gallium provides more electrons for the conduction band of the intermetallic compound to be formed than aluminum, whereby the intermetallic compound has an increased similarity to a pure metal and will therefore be less brittle than intermetallic compounds formed with aluminum and/or titanium. Furthermore, the coefficient of diffusion of gallium in nickel is remarkably smaller than the respective coefficient of aluminum in nickel and titanium in nickel, whereby Ostwald ripening in the alloy according to the invention is expected to be suppressed as compared to an alloy containing only aluminum and/or titanium. Thereby, superior creep rupture properties can be established for the alloy, however without the usual danger of undue embrittlement to occur, thus retaining good ductility properties.

It is preferred that the matrix of the alloy has a face-centered cubic crystal structure; the same is preferred for the precipitate. Thereby, the alloy has usual properties of a typical nickel-base superalloy.

The intermetallic nickel compound in the alloy may contain at least one metal selected from the group consisting of aluminum and titanium. More preferred, the intermetallic nickel compound contains aluminum, and still more preferred, the alloy including the intermetallic nickel compound is essentially free of titanium. Thereby, some disadvantageous properties of titanium that have been evaluated recently are avoided in the alloy according to the invention.

A preferred embodiment of the alloy is characterized in that at least one other precipitate granularly dispersed in and incoherent with the matrix is present, the other precipitate selected from the group consisting of carbides, carbonitrides, nitrides and borides. Particularly, carbides and borides are ingredients which are frequently present in superalloys and have several advantageous properties known as such. Accordingly, such compounds may be used to obtain further improvements of the alloy.

More preferred, the alloy contains at least one element selected from the group consisting of carbon and boron.

Another preferred embodiment of the alloy is characterized in that the matrix contains at least one strengthening element. Such a strengthening element may in particular be selected from the group consisting of tungsten, molybdenum, tantalum and rhenium. These elements are known as such to be of interest as components of many superalloys due to their properties of strengthening the matrix and/or the precipitate. Tungsten, molybdenum and tantalum may also be important to form carbide precipitates.

In accordance with a further embodiment of the invention, the alloy contains cobalt. Cobalt may be applied as a strengthening element, and cobalt is of importance to suppress Ostwald ripening of the precipitate.

In accordance with yet another embodiment of the invention, the matrix of the alloy has an ordered crystal structure, in particular an ordered crystal structure obtainable by a directional solidification process at casting. Preferably, the matrix is formed as a single crystal.

In accordance with a particularly preferred embodiment, the alloy is composed of the following parts by weight:

| | |
|---|---|
| gallium | 7% to 8%, |
| aluminum | 2.5% to 3.5%, |
| chromium | 7% to 8%, |
| cobalt | 11% to 13%, |
| rhenium | 2.5% to 3.5%, |
| carbon | 0.05% to 0.12%, |
| tantalum | 6% to 7%, |
| molybdenum | 1% to 2%, |
| tungsten | 4.5% to 5.5%, and |
| balance nickel and unavoidable impurities. | |

In accordance with an alternatively preferred embodiment, the alloy is composed of the following parts by weight:

| | |
|---|---|
| gallium | 9% to 10%, |
| aluminum | 1.5% to 2.5%, |
| chromium | 11.5% to 13.0%, |
| cobalt | 8% to 10%, |
| carbon | 0.05% to 0.12%, |
| tantalum | 3.5% to 4.5%, |
| molybdenum | 1.5% to 2.5%, |
| tungsten | 3.5% to 4.5%, |
| boron | 0.01% to 0.02%, |
| zirconium | 0.01% to 0.03%, and |
| balance nickel and unavoidable impurities. | |

The two different alloys particularly specified herein before are also preferred to form a substrate of an article of manufacture according to the invention, as specified herein below.

With respect to unavoidably impurities, it should be noted that according to usual practice the composition of a superalloy must be very carefully controlled and elements such as sulphur, phosphorus, tellurium and other kept at the lowest possible levels. It is also to be appreciated that methods for manufacture which are configured to provide "ultra-clean" alloys are preferred as well. However, it must be noted that all commercially available manufacturing processes do leave traces of certain impurities, and these impurities have of course to be taken into account in the context of the invention.

With the herein above specified and other objects in view, there is also specified, in accordance with the invention, an article of manufacture containing a substrate formed of the nickel-base alloy. The alloy contains the continuous matrix composed of the solid solution of chromium in nickel and the precipitate granularly dispersed in and coherent with the matrix and composed of the intermetallic nickel compound, wherein the intermetallic nickel compound contains gallium.

All advantages and preferred embodiments of the alloy in accordance with the invention apply as well to the article of manufacture of the invention and are here and hereby incorporated by reference.

In accordance with a preferred embodiment, the substrate of the article is a load-bearing part to bear at least all mechanical load imparted upon the article during its service.

According with another preferred embodiment, the substrate of the article is at least partly covered by a protective coating. The protective coating in particular lends itself to protect the article against corrosion and oxidation and more preferably also against excessive thermal load. In this context, the protective coating may contain a ceramic thermal barrier layer. To anchor such a ceramic layer, the protective coating may contain a bond coating which bonds the ceramic layer to the substrate.

In accordance with a further preferred embodiment, the substrate of the article forms a gas turbine component, in particular a blade, a vane or a heat shield element. In this context, the article may be exposed to a hot gas stream having a mean temperature of more than 1000° C., in particular amounting up to and eventually exceeding 1400° C. It is understood that such a hot gas stream may require a protective coating eventually containing a ceramic thermal barrier layer placed on the substrate, to keep the thermal load of the substrate within reasonable limits.

Two particularly preferred examples to actually use the invention are now explained. Two particular compositions of alloys according to the invention have already been mentioned. The first of these compositions has 7% to 8% gallium and 7% to 8% chromium. This composition is contemplated as a replacement for an alloy that is to be shaped with a single crystal matrix by directional solidification and applied for articles of manufacture in the form of components for military jet engines. The second composition having 9% to 10% gallium and 11.5% to 13% chromium is contemplated as a replacement for an alloy to be processed by a normal investment casting process without directional solidification or the like to form articles of manufacture in the form of components for stationary gas turbines. The strength of that alloy is expected to be medium high, but the alloy is expected to be useful for very long-term service, as is common in stationary gas turbines for power generation.

It is to be understood that both preferred alloys have to be shaped as specified and heat-treated in accordance with the relevant teachings of the state of art and as specified in the book referred to herein above.

It should be noted that both preferred alloys do not contain titanium, in order to avoid problems which have occurred in commercially used superalloys containing titanium.

The invention relates to a nickel-base alloy and an article of manufacture having a substrate formed of that alloy, which alloy has superior ductility and creep rupture properties.

I claim:

1. A nickel-base alloy for high temperature application, comprising:

a continuous matrix composed of a solid solution of chromium in nickel and a precipitate composed of an intermetallic nickel compound and granularly dispersed in and coherent with said continuous matrix, said intermetallic nickel compound containing gallium, said continuous matrix containing gallium oxide ($Ga_2O_3$) for providing a high corrosion resistance and having a balance of nickel, chromium and unavoidable impurities.

2. The alloy according to claim 1, wherein said intermetallic nickel compound contains at least one metal selected from the group consisting of aluminum and titanium.

3. The alloy according to claim 1, wherein said continuous matrix contains:

a) at least one other precipitate granularly dispersed in and incoherent with said continuous matrix, said at least one other precipitate selected from the group consisting of carbides, carbonitrides, nitrides and borides;

b) at least one strengthening element selected from the group consisting of tungsten, molybdenum, tantalum and rhenium;

c) cobalt; and d) zirconium.

4. The alloy according to claim 1, wherein:

said intermetallic nickel compound contains at least one metal selected from the group consisting of aluminum and titanium; and said continuous matrix containing:

a) at least one other precipitate granularly dispersed in and incoherent with said continuous matrix, said at least one other precipitate selected from the group consisting of carbides, carbonitrides, nitrides and borides;

b) at least one strengthening element selected from the group consisting of tungsten, molybdenum, tantalum and rhenium;

c) cobalt; and d) zirconium.

5. The alloy according to claim 4, wherein said continuous matrix contains the following parts by weight:

| | |
|---|---|
| said gallium | 7% to 8%, |
| said aluminum | 2.5% to 3.5%, |
| said chromium | 7% to 8%, |
| said cobalt | 11% to 13%, |
| said rhenium | 2.5% to 3.5%, |
| carbon | 0.05% to 0.12%, |
| said tantalum | 6% to 7%, |
| said molybdenum | 1% to 2%, |
| said tungsten | 4.5% to 5.5%, and |
| balance said nickel and said unavoidable impurities. | |

6. The alloy according to claim 4, wherein said continuous matrix is composed of the following parts by weight:

| | |
|---|---|
| said gallium | 9% to 10%, |
| said aluminum | 1.5% to 2.5%, |
| said chromium | 11.5% to 13.0%, |
| said cobalt | 8% to 10%, |
| carbon | 0.05% to 0.12%, |
| said tantalum | 3.5% to 4.5%, |
| said molybdenum | 1.5% to 2.5%, |
| said tungsten | 3.5% to 4.5%, |
| boron | 0.01% to 0.02%, |
| said zirconium | 0.01% to 0.03%, and |
| balance said nickel and said unavoidable impurities. | |

7. The alloy according to claim 1, wherein said continuous matrix has a face centered cubic crystal structure.

8. The alloy according to claim 1, wherein said precipitate has a face centered cubic crystal structure.

9. The alloy according to claim 1, wherein said intermetallic nickel compound contains aluminum.

10. The alloy according to claim 1, wherein said continuous matrix is substantially free of titanium.

11. The alloy according to claim 1, wherein said continuous matrix includes at least one element selected from the group consisting of carbon and boron.

12. The alloy according to claim 1, wherein said continuous matrix contains at least one strengthening element.

13. The alloy according to claim 1, wherein said continuous matrix has an ordered crystal structure.

14. The alloy according to claim 13, wherein said continuous matrix is a single crystal.

15. The nickel-base alloy according to claim 1, wherein said precipitate has a volume of up to fifty percent of said matrix.

16. An article of manufacture for a high-temperature application, comprising:

a substrate formed of one nickel-base alloy containing a continuous matrix composed of a solid solution of chromium in nickel and a precipitate composed of an intermetallic nickel compound and granularly dispersed in and coherent with said continuous matrix, said intermetallic nickel compound containing gallium and said continuous matrix containing gallium oxide ($Ga_2O_3$) for providing high corrosion resistance.

17. The article according to claim 16, wherein said intermetallic nickel compound contains at least one metal selected from the group consisting of aluminum and titanium.

18. The article according to claim 17, wherein said substrate is composed of the following parts by weight:

| | |
|---|---|
| said gallium | 7% to 8%, |
| said aluminum | 2.5% to 3.5%, |
| said chromium | 7% to 8%, |
| cobalt | 11% to 13%, |
| rhenium | 2.5% to 3.5%, |
| carbon | 0.05% to 0.12%, |
| tantalum | 6% to 7%, |
| molybdenum | 1% to 2%, |
| tungsten | 4.5% to 5.5%, and |
| balance being said nickel and unavoidable impurities. | |

19. The article according to claim 17, wherein said substrate is composed of the following parts by weight:

| | |
|---|---|
| said gallium | 9% to 10%, |
| said aluminum | 1.5% to 2.5%, |
| said chromium | 11.5% to 13.0%, |
| cobalt | 8% to 10%, |
| carbon | 0.05% to 0.12%, |
| tantalum | 3.5% to 4.5%, |
| molybdenum | 1.5% to 2.5%, |
| tungsten | 3.5% to 4.5%, |
| boron | 0.01% to 0.02%, |
| zirconium | 0.01% to 0.03%, and |
| balance being said nickel and unavoidable impurities. | |

20. The article according to claim 16, wherein said substrate is a load-bearing part.

21. The article according to claim 20, including a protective coating at least partly covering said substrate.

22. The article according to claim 20, wherein said substrate forms a gas turbine component selected from the group consisting of a blade, a vane or a heat shield element.

23. The article according to claim 16, wherein said substrate is configured for use at a temperature of more than 1000° C.

24. The article according to claim 16, wherein said precipitate has a volume of up to fifty percent of said matrix.

25. A nickel-base alloy for high temperature application, comprising:

a continuous matrix composed of a solid solution of chromium in nickel and a precipitate composed of one intermetallic nickel compound and granularly dispersed in and coherent with said continuous matrix, said intermetallic nickel compound containing between 7% and 10% gallium, said continuous matrix containing gallium oxide ($Ga_2O_3$) for providing a high corrosion resistance and having a balance of nickel, chromium and unavoidable impurities.

* * * * *